US005201307A

United States Patent [19]

Afshar

[11] Patent Number: 5,201,307

[45] Date of Patent: Apr. 13, 1993

[54] INSULATED FIREBOX FOR SWIMMING POOL OR SPA HEATERS FOR REDUCTION OF SMOKE OR ODOR

[75] Inventor: Mohammad R. Afshar, Diamond Bar, Calif.

[73] Assignee: Hydrotech Chemical Corp., City of Industry, Calif.

[21] Appl. No.: 789,051

[22] Filed: Nov. 7, 1991

[51] Int. Cl.[5] ..... F22B 21/04

[52] U.S. Cl. ..... 126/344; 122/14; 122/19; 126/350 R

[58] Field of Search ..... 110/317, 318, 319; 126/344, 350 R; 122/14, 19

[56] References Cited

U.S. PATENT DOCUMENTS

| | | | |
|---|---|---|---|
| 2,805,633 | 9/1957 | Naulin | 110/317 |
| 3,336,716 | 8/1967 | Scheppers | 110/317 X |
| 4,344,386 | 8/1982 | Black | 122/19 |
| 4,501,232 | 2/1985 | Gordbegli et al. | 126/344 X |
| 4,553,488 | 11/1985 | Giuseppe | 110/346 |
| 4,759,298 | 7/1988 | Koptis et al. | 110/190 |
| 4,893,609 | 1/1990 | Giordani et al. | 126/350 R |
| 4,970,969 | 11/1990 | Koptis et al. | 110/190 |
| 5,024,210 | 6/1991 | Nelson | 126/344 |

*Primary Examiner*—Edward G. Favors
*Attorney, Agent, or Firm*—Woodard, Emhardt, Naughton, Moriarty & McNett

[57] ABSTRACT

An insulated firebox is disclosed which forms a portion of the combustion chamber of a pool heater and which is adapted for reducing the emission of smoke and odor from the firebox into the atmosphere. The firebox is comprised of insulation material which defines a combustion chamber enclosed by the insulation on its vertical sides. The insulation contains organic materials capable of resulting in the generation of smoke or odor. A liner extends substantially continuously about the insulation and seals the vertical sides of the combustion chamber from the escape therethrough of the organic materials contained by the insulation. The organic materials are thus directed into the combustion chamber, where the higher temperature will result in more complete combustion of the materials with a consequent reduction or elimination of the potential smoke or odor.

10 Claims, 4 Drawing Sheets

INSULATED FIREBOX FOR SWIMMING POOL OR SPA HEATERS FOR REDUCTION OF SMOKE OR ODOR

BACKGROUND OF THE INVENTION

1. Field of the Invention

The present invention relates generally to liquid heaters and particularly to swimming pool and spa heaters which transfer heat to liquid circulated through a heat exchanger.

2. Description of the Prior Art

Furnace design in general is a relatively old although the development of pool or spa heaters is relatively recent. Due to the increasing cost of fuels, designers of heaters or furnaces have become more concerned with increasing efficiency in their designs. Increasing emphasis has also been placed upon reducing the emission of pollutants, including unburned hydrocarbons, which may contaminate the environment and produce unpleasant odors. The present invention addresses the requirements of increased pool heater efficiency and the reduced smoke and odor through use of an improved insulated firebox.

The elimination of smoke from furnaces and incinerators has been the subject matter of several recent patents. U.S. Pat. Nos. 4,759,298 and 4,970,969 to Koptis et al. refer to the elimination of smoke released from a pyrolysis furnace. A pyrolysis furnace is used to reclaim and recycle metal parts that contain organic materials. The furnace volatilizes and burns the organic material which is bound to the metal parts. The volatiles are also burned in an afterburner chamber in the described furnaces. The furnace utilizes a thermocouple and water spray to maintain the combustion in the furnace within safe limits.

U.S. Pat. No. 4,553,488 to Giuseppe relates to a procedure and furnace for incineration of waste material without producing smoke. The incinerator has a steel cylindrical body and a heated plate which presses upon the material to be consumed. Heat is transferred from the heated plate to the waste material which is carbonized, distilled and ignited. Air is introduced under pressure to further achieve and sustain combustion and to avoid the formation of smoke.

In pool or spa heaters, a combustion chamber is commonly located inside a firebox. Insulation is used to define the firebox surrounding the combustion chamber to increase the heater's efficiency and also to reduce the exterior temperature of the heater. One problem with such insulation, however, is that organic materials in the insulation may produce smoke during start-up or continued operation of the heater. For example, insulation containing organic material heated to a temperature range of about 200°-300° F. may generate smoke or odor during start-up as a result of incomplete combustion of the organic material at these lower temperatures.

Also, for insulated fireboxes, a temperature gradient will exist in the insulation, causing the insulation temperature to decrease as the distance from the combustion chamber increases. When a fire is present, organic constituents in the combustion chamber will burn without generating smoke. However, the insulation farther from the combustion chamber will be at a lower temperature, and organic material that is present may create smoke.

Commonly this smoke escapes into the atmosphere and may become visible to those using the heater. Some particles of the smoke may deposit upon or in the vicinity of the heater. Furthermore, smoke produced at lower temperatures has a very pungent odor which may be objectionable to and may alarm users of the heater. This production of pungent smoke by pool or spa heaters and the deposition of particles in the vicinity of and upon the heater may be particularly noticeable if the heater is installed in an enclosed area. Installation of the pool or spa heater in a shed or pool-house may trap the smoke or odor and allow it to concentrate, thereby exacerbating the problem.

SUMMARY OF THE INVENTION

In one aspect of the present invention there is provided an insulated firebox which forms a portion of the combustion chamber of a pool heater and which is adapted for reducing the emission of smoke and odor from the firebox into the atmosphere, the firebox comprising insulation material defining a combustion chamber enclosed by the insulation on its vertical sides, the insulation containing organic materials capable of resulting in the generation of smoke or odor, and a liner extending substantially continuously about the insulation material and sealing the vertical sides of the combustion chamber from the escape therethrough of the organic materials contained by said insulation.

It is an object of the present invention to provide a swimming pool or spa heater with an improved insulated firebox to reduce the release of smoke or odor into the atmosphere upon start-up.

It is a further object of the present invention to provide a swimming pool or spa heater with an improved insulated firebox having a metallic liner to seal off the outer layer of insulation and thereby prevent the escape of smoke or odor.

It is another object of the present invention to provide a swimming pool or spa heater with an improved insulated firebox designed to draw smoke or odor upon start-up into an area of increased temperature where it may be consumed.

Related objects and advantages of the present invention will become more apparent by reference to the following figures and detailed description.

DESCRIPTION OF THE PREFERRED EMBODIMENT

Figure 1:
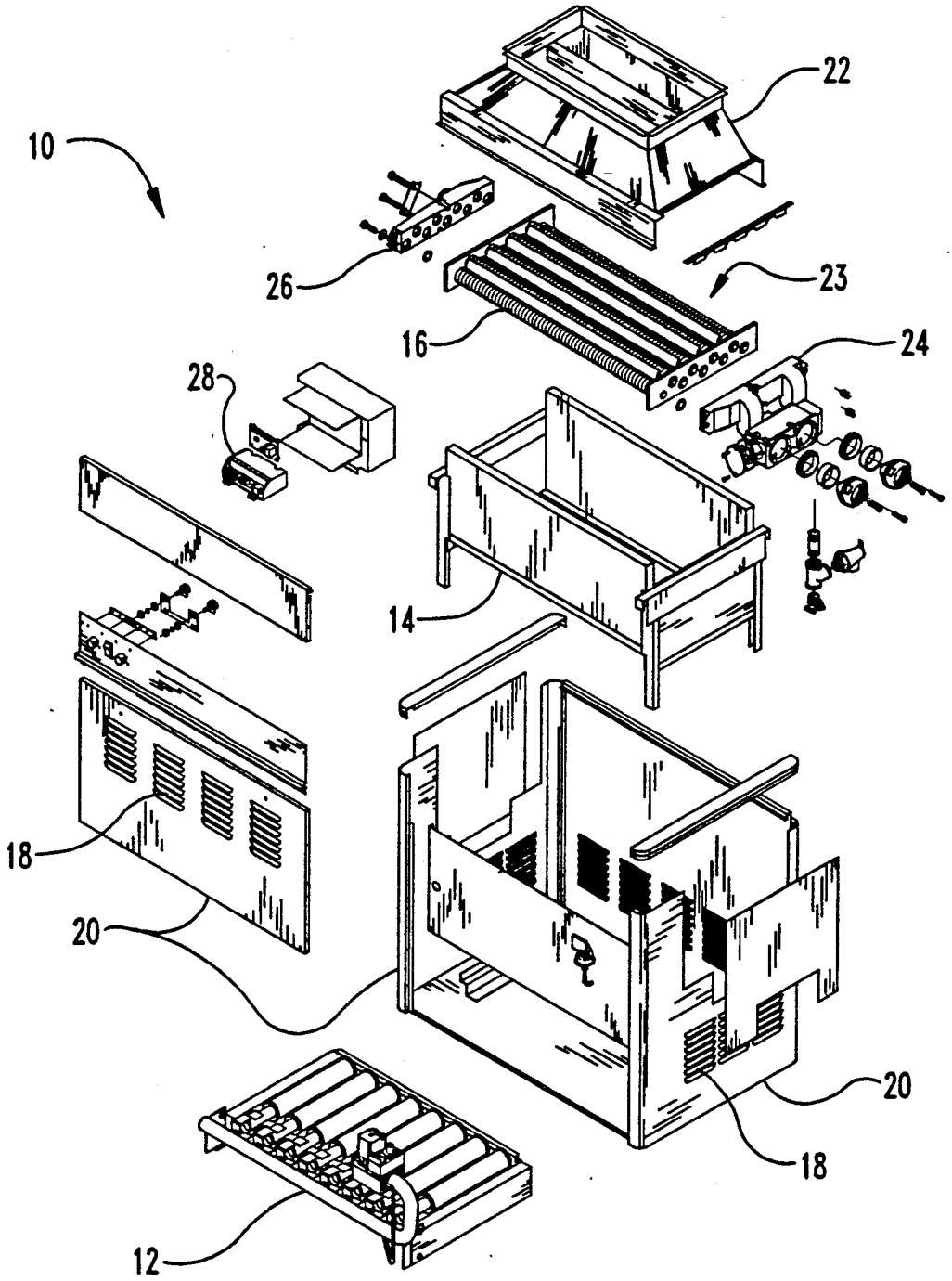
FIG. 1 is an exploded perspective view showing various components of a pool or spa heater.

For the purposes of promoting an understanding of the principles of the invention, reference will now be made to the embodiment illustrated in the drawings and specific language will be used to describe the same. It will nevertheless be understood that no limitations of the scope of the invention is thereby intended, such alternations and further modifications in the illustrated device, and such further applications of the principles of the invention as illustrated therein being contemplated as would normally occur to one skilled in the art to which the invention relates.

Referring to FIG. 1, an exploded perspective view of a pool or spa heater 10 is illustrated. The pool or spa heater 10 generally includes a gas-type burner 12 mounted under an insulated firebox 14. A heat exchanger 16 extends horizontally above the upper portion of insulated firebox 14 above the burner 12. Fresh air for combustion of the fuel is admitted by a plurality of louvers 18 formed in the front, rear and side walls of housing 20. A flue collector 22 allows the ventilation of excess heated gases from the combustion chamber.

Heat exchanger assembly 23 includes the heat exchanger 16 which extends between and is in fluid communication with a manifold 24 and a return header 26. The pool heater 10 has an adjustable thermostat 28 to allow maintenance of a desired water temperature for the spa or pool. The temperature of the circulated liquid is maintained in conventional fashion by the appropriate adjustment of the thermostat which controls the cycling of the heater. The gas burner 12 heats the surrounding gases in the combustion chamber and this heat is transferred to the liquid circulating in the heat exchanger assembly 23. The liquid entering the inlet of the manifold 24 passes thorough the inlet passages in the heat exchanger 16 to the return header 26 which returns the fluid back through the outlet passages in the heat exchanger for additional heat transfer. The fluid next passes from the outlet passages in the heat exchange 16 to the outlet in the manifold 24.

The foregoing description of a pool or spa heater is typical of units existing in the prior art. The particular arrangement and design of such components as the housing, burner, etc. do not form a part of the present invention, and are not to be construed as limiting. Instead, this description is provided by way of background, in view of which the features of the present invention may be more readily understood.

Figure 2:
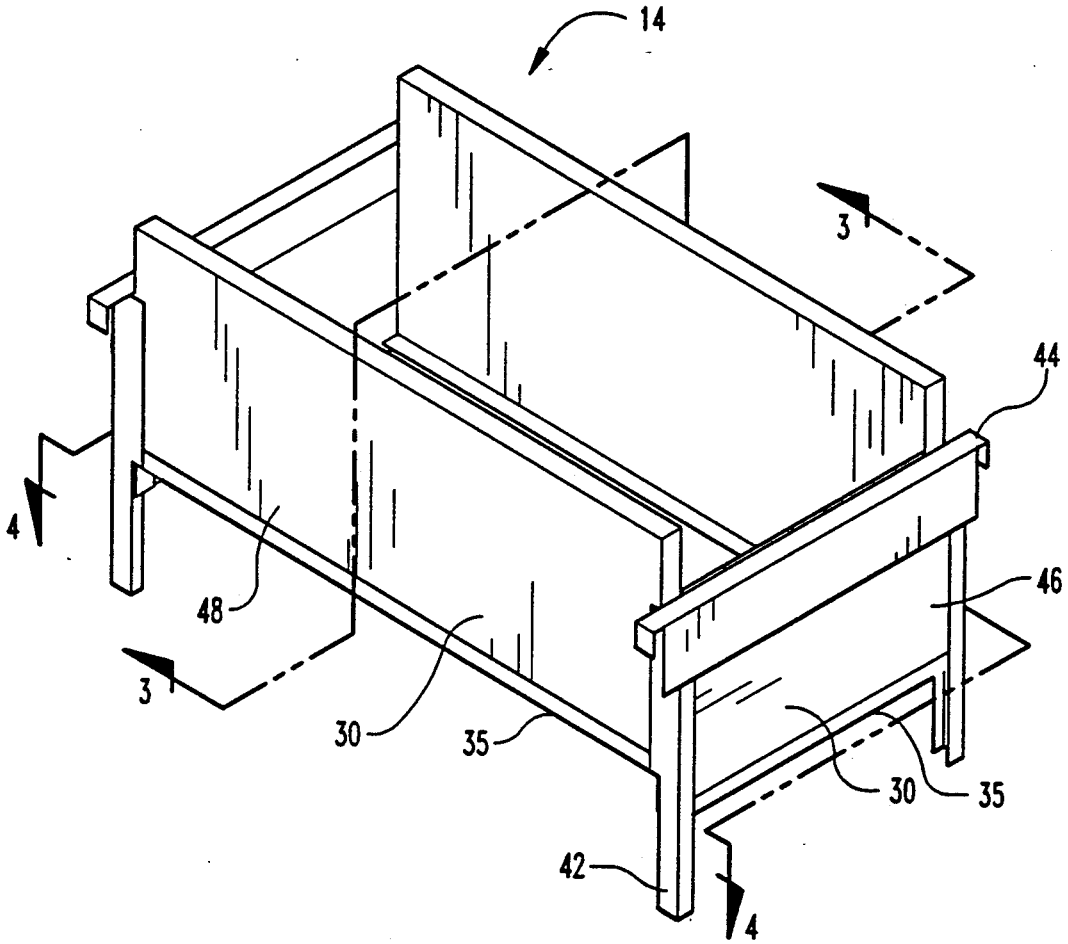
FIG. 2 is a perspective view looking from the right front side of the fiberbox of FIG. 1.
Figure 3:
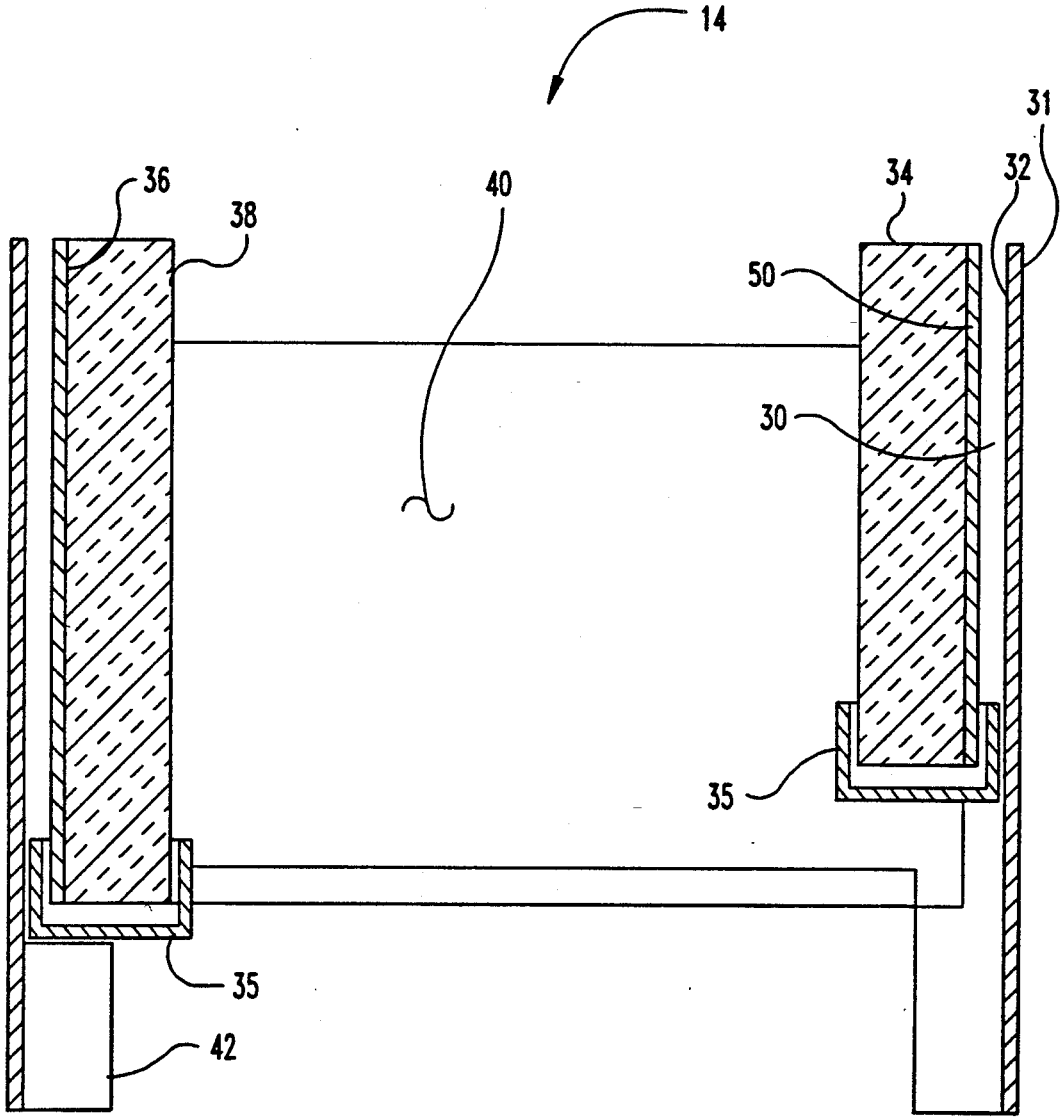
FIG. 3 is a section view of the firebox taken along the line 3—3 in FIG. 2 and looking in the direction of the arrows.
Figure 4:
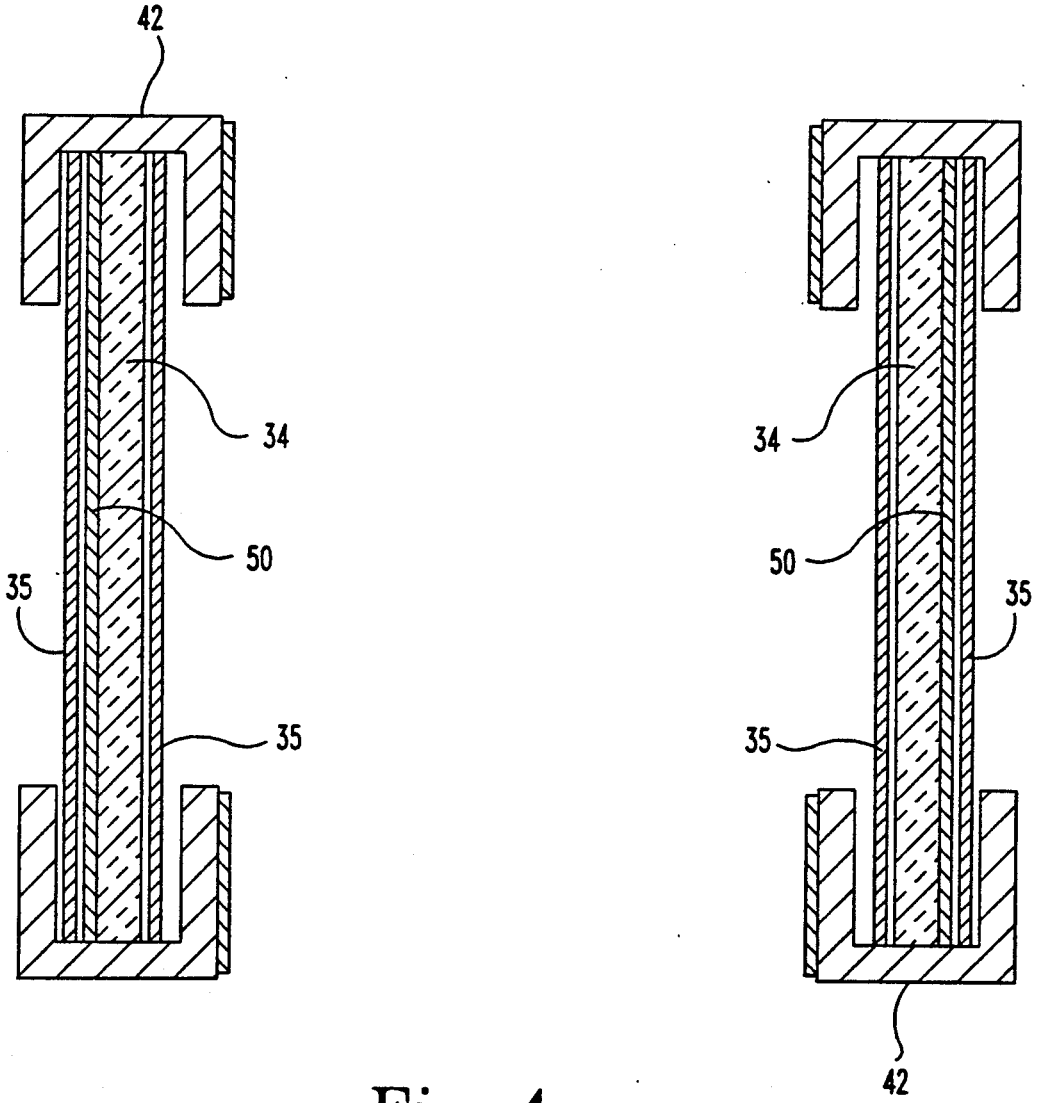
FIG. 4 is a section view of the firebox taken along the line 4—4 in FIG. 2 and looking in the direction of the arrows.

Referring not to FIGS. 2, 3 and 4, the preferred embodiment of the insulated firebox 14 will now be described in detail. The insulated firebox is constructed from a plurality of vertically-extending walls 30 which extend about the sides of and define the combustion chamber 40. The walls 30 comprise sheets of insulation 34 which are utilized to reduce heat loss from the firebox and increase both combustion efficiency and the efficiency of heat transfer to the circulating liquid. The sheets of insulation 34 include outer and inner surfaces 36 and 38, respectively. The inner surfaces 38 of the insulation are exposed to and define the combustion chamber 40.

The walls are received within a framework which includes four legs 42 and upwardly-open channel members 35. The insulation panels 34 are received in the channels 35 (FIG. 3 and 4). The legs elevate the insulated firebox 14 above the surface upon which it rests. Supports 44 for the heat exchanger apparatus 23 are located on the sides 46 of the insulated firebox.

The legs 42 further allow the gas burner 12 to be placed under the insulated firebox 14. As may be seen from the illustration, the sides 48 are elevated in relation to the sides 46 to allow the gas burner to slide into the firebox. The gas burner 12, when placed into normal operating position under the firebox, is partially enclosed by the sides 46. The elevated sides 48 extend higher than the sides 46 to allow partial enclosure of the heat exchanger apparatus 23 by the firebox when it is placed into normal operating position above the gas burner 12 upon supports 44. This configuration of the firebox walls 30 further includes the efficiency of the pool of spa heater.

The sheets of insulation 34 may utilize organic materials such as starch as a binder, and may include other organic materials. The insulation may be made of ceramic, fiberglass, polymeric foam or other commonly used materials for insulation. The preferred insulation utilizes ceramic fiber with a starch binder. This combination of ceramic fiber with starch binder produces an insulation having great strength and durability and is ideally suite for use in furnace fiberboxes. Insulation lacking organic material generally does not create smoke, but is less preferred because it is more expensive and has less strength and integrity than insulation made of ceramic fiber and starch binder. As previously discussed, the presence of these organic materials may result in the generation of smoke and/or odor due to the escape from the firebox of incompletely combusted materials. The inventive firebox addresses the only potential drawback of the preferred insulation, the production of smoke in a narrow temperature range.

In accordance with the present invention, positioned adjacent the outer surfaces 36 of the insulation 34 is a substantially continuous liner 50. The liner functions to seal the outer perimeter of the insulation 34, and therefore extends fully about the perimeter of the firebox along the exterior of the insulation. The liner must retain its shape, resist deterioration and be capable of sealing the surface of the insulation in a temperature ranging from 300° to 400° F. The preferred liner is formed from sheet metal or a laminated metallic foil, both of which are suitable for use at the high temperatures to which the liner will be exposed and which function to substantially prevent the transmission of the organic materials therethrough. As shown in the drawings, the liner may conveniently comprise several metallic panels which extend along the sides of the insulation and are received within the channel members 35. In this manner, the liner panels cooperate with the four legs to provide a substantially continuous seal extending about the perimeter of the insulation forming the combustion chamber. Alternatively, a continuous liner material could be used.

Given the presence of the liner, any organic materials in the insulation which might otherwise result in the generation of smoke or odor are not allowed to escape outwardly, such as through vents 18, but rather are forced inwardly toward the combustion chamber. The organic materials are thus directed into the combustion chamber, where the higher temperature will result in more complete combustion of the materials with a consequent reduction or elimination of the potential smoke or odor.

A further advantage of the liner is the protection afforded the insulation from rain or water splashes. The liner is arranged to nearly encapsulate the insulation and is able to protect the insulation when the heater is placed in a wet environment. The liner sheds water and protects the insulation from water absorption which may cause a deterioration of the strength and insulating ability of the insulation.

When the gas burner 12 (FIG. 1) is lit, the presence of the liner 50 prevents the escape of smoke or odor during start-up by sealing off the outside of the insulation with a metal covering. The liner further allows the draft from the combustion process (negative pressure) to pull the smoke or organic particulate material through the insulation 34, which has an open surface 38, to the combustion chamber 40 to allow the organic material to be consumed in an area of higher temperature. Such smoke or odor is generally burned or consumed by temperatures above 300° F., which are quickly attained in the combustion chamber.

While the invention has been illustrated and described in detail in the drawings and foregoing description, the same is to be considered as illustrative and not restrictive in character, it being understood that only the preferred embodiment has bene shown and described and that all changes and modifications that come within the spirit of the invention are desired to be protected.

What is claimed is:

1. An insulated firebox which forms a portion of the combustion chamber of a pool heater and which is adapted for reducing the emission of smoke and odor from the firebox into the atmosphere, comprising:

insulation material defining a combustion chamber enclosed by said insulation on its vertical sides, said insulation containing organic materials capable of resulting in the generation of smoke or odor; and a liner extending substantially continuously about said insulation material and sealing the vertical sides of the combustion chamber from the escape therethrough of the organic materials contained by said insulation, said firebox comprising four upstanding legs defining corners of the combustion chamber, upwardly open channel members extending between respective pairs of said legs, insulation panels extending vertically between respective pairs of said legs and being received in the upwardly open channel members, and liner panels received adjacent the outer surfaces of said insulation panels and being received in the upwardly open channel members.

2. The firebox of claim 1 wherein said liner consists of a laminated metallic foil.

3. The firebox of claim 1 in which said liner consists of sheet metal.

4. The firebox of claim 1 in which said four legs include horizontally facing channels, said insulation panels and said liner panels having ends received within the channels of said legs.

5. In a swimming pool or spa heater which comprises a housing, an insulated firebox mounted within the housing, a burner located below the firebox, and a heat exchanger extending horizontally above the firebox, the improvement comprising the firebox including:

insulation material defining a combustion chamber enclosed by said insulation material on its vertical sides, said insulation material containing organic materials capable of resulting in the generation of smoke or odor; and a liner extending substantially continuously about said insulation material and sealing the vertical sides of the combustion chamber from the escape therethrough of the organic materials contained by said insulation material.

6. The improvement of claim 5 in which said liner consists of a laminated metallic foil.

7. The improvement of claim 5 in which said liner consist of sheet metal.

8. A swimming pool or spa heater which comprises:

a housing:

an insulated firebox mounted within said housing, said firebox including insulation material defining a combustion chamber enclosed the insulation material on its vertical sides, the insulation material containing organic materials capable of resulting in the generation of smoke or odor, and a liner extending substantially continuously about the insulation material and sealing the vertical sides of the combustion chamber from the escape therethrough of the organic materials contained by the insulation material;

a burner located below said firebox; and a heat exchanger extending horizontally above said firebox.

9. The improvement of claim 8 in which said liner consists of a laminated metallic foil.

10. The improvement of claim 8 in which said liner consists of sheet metal.

* * * * *